US008458835B2

(12) United States Patent
Muratalla

(10) Patent No.: US 8,458,835 B2
(45) Date of Patent: Jun. 11, 2013

(54) BREAST SUPPORT PILLOW

(76) Inventor: Amy Muratalla, West Vocina, CA (US)

( * ) Notice: Subject to any disclaimer, the term of this patent is extended or adjusted under 35 U.S.C. 154(b) by 98 days.

(21) Appl. No.: 12/901,488

(22) Filed: Oct. 8, 2010

(65) Prior Publication Data

US 2011/0083278 A1 Apr. 14, 2011

Related U.S. Application Data

(60) Provisional application No. 61/249,986, filed on Oct. 8, 2009.

(51) Int. Cl.
*A47C 31/00* (2006.01)

(52) U.S. Cl.
USPC ..... 5/655.9; 5/632; 5/630; 5/930

(58) Field of Classification Search
USPC ..... 5/632, 655.9, 630, 735, 727, 930
See application file for complete search history.

(56) References Cited

U.S. PATENT DOCUMENTS

| | | | | |
|---|---|---|---|---|
| 1,548,728 | A * | 8/1925 | Milam et al. | 5/722 |
| D309,542 | S | 7/1990 | Glenn | |
| D318,923 | S | 8/1991 | Marsh | |
| 5,095,569 | A | 3/1992 | Glenn | |
| 5,297,303 | A * | 3/1994 | Stafford et al. | 5/613 |
| 5,369,824 | A | 12/1994 | Powell | |
| 5,400,449 | A | 3/1995 | Sator | |
| 5,720,061 | A | 2/1998 | Giori | |
| 6,042,604 | A | 3/2000 | Gennetti | |
| 6,052,847 | A | 4/2000 | Allyn | |
| 6,081,948 | A | 7/2000 | Copeland | |
| 6,185,768 | B1 | 2/2001 | Schlechter | |
| 6,922,859 | B2 * | 8/2005 | Gagnon et al. | 5/601 |
| 7,194,778 | B2 | 3/2007 | Riach | |
| 7,426,762 | B2 | 9/2008 | Dazzi | |
| D578,220 | S | 10/2008 | Ebarb | |
| D585,139 | S * | 1/2009 | Andrews | D24/184 |
| 2004/0029484 | A1 | 2/2004 | Smith | |

* cited by examiner

*Primary Examiner* — Robert G Santos
*Assistant Examiner* — Brittany Wilson
(74) *Attorney, Agent, or Firm* — Thien Tran, Esq.; Access Patent Group, LLC

(57) ABSTRACT

A breast support pillow includes a wedge-shaped rectangular even flat surface pad thicker at a top end with an inclined upper surface and being of sufficient length to support a torso and a head of an individual/woman. The pad has a double cup recess within the upper surface at about mid-point of the length of the pad to receive the different sizes of inserts in order to different breasts' sized of the woman in a comfortable manner therein.

8 Claims, 5 Drawing Sheets

BREAST SUPPORT PILLOW

CROSS-REFERENCE TO RELATED APPLICATION

This application claims the benefit of Provisional Patent Application No. 61/249,986, filed on Oct. 8, 2009, in the United States Patent & Trademark Office, the disclosure of which is incorporated herein by reference.

BACKGROUND OF THE INVENTION

1. Field of the Invention

The present invention relates to a therapeutic pillow, and more particularly, a breast support pillow.

The breast support pillow is configured to bring relief and care to an individual/woman who may experience discomfort in the breast area while sleeping. This product assists the individual/woman in obtaining a better night's sleep by providing a comfortable support pillow for the breasts. The pillow relieves the discomfort of sensitive, sore breasts that can often affect a sleep cycle of the individual/woman.

2. Description of the Prior Art

There are many reasons why a woman may experience breast soreness. Certain illnesses cause breast tenderness or lumps, or individual/women who undergo breast enhancement, which can make it difficult for the woman to sleep. Various times of the month can cause the woman's breasts to be hypersensitive. Large breasted women often have trouble getting comfortable during the night. A standard mattress does not offer a sufficient amount of support for sore breasts or individual/women who undergo breast enhancement can benefit. A more efficient way is needed.

Numerous innovations for breast comfort systems have been provided in the prior art that will be described. Even though these innovations may be suitable for the specific individual purposes to which they address, however, they differ from the present invention.

A first example, U.S. Pat. No. 3,967,335, Issued on Jul. 6, 1976, to Rhoads teaches a cushion or pillow of foam rubber that has two circular holes cut therein to receive the mammary glands of a woman lying thereon. The cushion is covered with terry cloth for sunbathing or covered with satin for sleeping. The cushion extends upward to form a support for the head.

A second example, U.S. Patent Office Document No. D309,542, Issued on Jul. 31, 1990, to Glenn teaches an ornamental design for an inflated face-down pillow for a woman, as shown and described.

A third example, U.S. Patent Office Document No. D318, 923, Issued on Aug. 6, 1991, to Marsh teaches an ornamental design for a therapeutic pillow, as shown and described.

A fourth example, U.S. Pat. No. 5,095,569, Issued on Mar. 17, 1992, to Glenn teaches a compliant cover sheet for a face-down pillow which has a wedge shape and contains primary and secondary air passageways which facilitate breathing by the user of the pillow. The sheet is fabricated of a single piece of flat compliant thin material cut so as to have a perimeter edge configuration generally matching the configuration of the pillow. Intersecting slits adjacent the upper extremity of the sheet form triangular flaps which descend into the primary passageway. Fastening straps attached to the flaps are adapted to pass through the secondary air passageways and interengage edges of the sheet. A stabilizing strap attached across opposed edges of the sheet adjacent its lower extremity is adapted to embrace the pillow.

A fifth example, U.S. Pat No. 5,369,824, Issued on Dec. 6, 1994, to Powell teaches a reversible mattress for use by a pregnant woman. The mattress includes a planar first face having a cavity therein for accommodating the abdomen of the pregnant woman when the mattress is positioned with the first face facing upward and the pregnant woman lies prone upon the first face; and a planar second face having a cavity therein for accommodating the abdomen of the pregnant woman when the mattress is positioned with the second face facing upward and the pregnant woman lies prone upon the second face.

A sixth example, U.S. Pat. No. 5,400,449, Issued on Mar. 28, 1995, to Satto teaches a prone pregnancy cushion, for allowing a pregnant woman to lay on her abdomen, comprising an early stage segment, a later stage segment, and an attachment mechanism connecting the early stage segment and later stage segment. The early stage segment and later stage segment each have abdominal hollows and breast hollows, containing breast cut-outs and abdominal cut-outs which are removable to accommodate women of different sizes and at different stages of their pregnancy.

A seventh example, U.S. Pat. No. 5,720,061, Issued on Feb. 24, 1998, to Giori et al. teaches a female anatomical mattress including a generally rectangular body supporting structure. The body supporting structure has a pair of side walls with a continuous central section. The central section has an upper panel and a lower panel. The upper panel and lower panel each share a rounded front end and a rounded rear end. The upper panel has a generally rectangular cavity that extends downwardly therefrom and toward the lower panel. Lastly, a generally rectangular head supporting structure is rounded. The head supporting structure is sized for positioning within the cavity of the body supporting structure, when not supporting a person's head. The mattress may be foam filled or inflatable.

An eighth example, U.S. Pat. No. 6,052,874, Issued on Apr. 25, 2000, to Allyn et al. teaches a mattress having a wedge-shaped mattress body with an inclined upper surface, the upper surface divided by a transverse breast concavity into a head-supporting portion and a body-supporting portion. The mattress has a flat position in which the concavity is open to receive breasts as well as an upright position in which the concavity functions as a hinging mechanism and the mattress is held in the upright position by adjustable mechanisms. In the flat position the mattress may be used in the prone position, laying on the back, or in a yoga position. In the upright position, the mattress may be used laying on the back and partially sitting upright, or, by adjusting the position of the mattress, sitting upright.

A ninth example, U.S. Pat. No. 7,194,778, Issued on Mar. 27, 2007, to Riach teaches a breast comfort padding system which includes a compressible body having an upper surface sized to support at least a chest area of a user thereon, at least a pair of recesses formed in the compressible body which are positioned with respect to each other on the compressible body to correspond to position of breasts, and compressible inserts received in the recesses, the compressible insert being more easily compressed than the compressible body.

A tenth example, U.S. Pat. No. 7,426,762, Issued on Sep. 23, 2008, to Dazzi teaches a pillow suitable for women's body, allowing an easy resting an easy resting to women's chest, keeping breasts separated therebetween and raised, unflattened by the body. The pillow has a donut shape additionally allowing an effective body side support, and it comprises: a substantially oval annular pillow main body, having a central opening allowing breast insertion and a resting surface for the chest area surrounding the breast; a pillow secondary body of elongate shape, located transversely to the opening of the main body so as to position itself between the breasts, at the sternum.

An eleventh example, U.S. Patent Office Document No. D578,220, Issued on Oct. 7, 2008, to Ebarb teaches an ornamental design for a breast pillow, as shown and described.

A twelfth example, U.S. Patent Office Publication No. 2004/0029484, Published on Feb. 12, 2004, to Smith teaches abreast supporter which can be worn or held to a person's breast to provide protection and comfort, and particularly to reduce discomfort during or following breast implant surgery. The breast supporter can provide one or more depressions or cups for resting of breasts, wherein the breast supporter can be inflatable, and wherein the size(s) of the depression(s) or the cup(s) or the opening(s) is/are adjustable.

A thirteenth example, U.S. Pat. No. 7,194,778, Issued on Mar. 27, 2007, to Riach teaches a breast comfort padding system which includes a compressible body having an upper surface sized to support at least a chest area of a user thereon, at least a pair of recesses formed in the compressible body which are positioned with respect to each other on the compressible body to correspond to position of breasts, and compressible inserts received in the recesses, the compressible insert being more easily compressed than the compressible body.

A fourteenth example, U.S. Pat. No. 7,426,762, Issued on Sep. 23, 2008, to Dazzi teaches a pillow suitable for women's body, allowing an easy resting an easy resting to women's chest, keeping breasts separated therebetween and raised, unflattened by the body. The pillow has a donut shape additionally allowing an effective body side support, and it comprises: a substantially oval annular pillow main body, having a central opening allowing breast insertion and a resting surface for the chest area surrounding the breast; a pillow secondary body of elongate shape, located transversely to the opening of the main body so as to position itself between the breasts, at the sternum.

It is apparent now that numerous innovations for breast comfort systems have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

An object of the present invention is to provide a breast support pillow that avoids the disadvantages of the prior art.

Another object of the present invention is to provide a breast support pillow that is simple and inexpensive to manufacture.

Still another object of the present invention is to provide a breast support pillow that is simple to use.

Briefly stated, still yet another object of the present invention is to provide a breast support pillow comprises a wedge-shaped rectangular flat even surface pad thicker at a top end with an inclined upper surface and being of sufficient length to support a torso and a head of an individual/woman. The pad has a double cup recess within the upper surface at about mid-point of the length of the pad to receive the breasts of the individual/woman in a comfortable manner therein.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
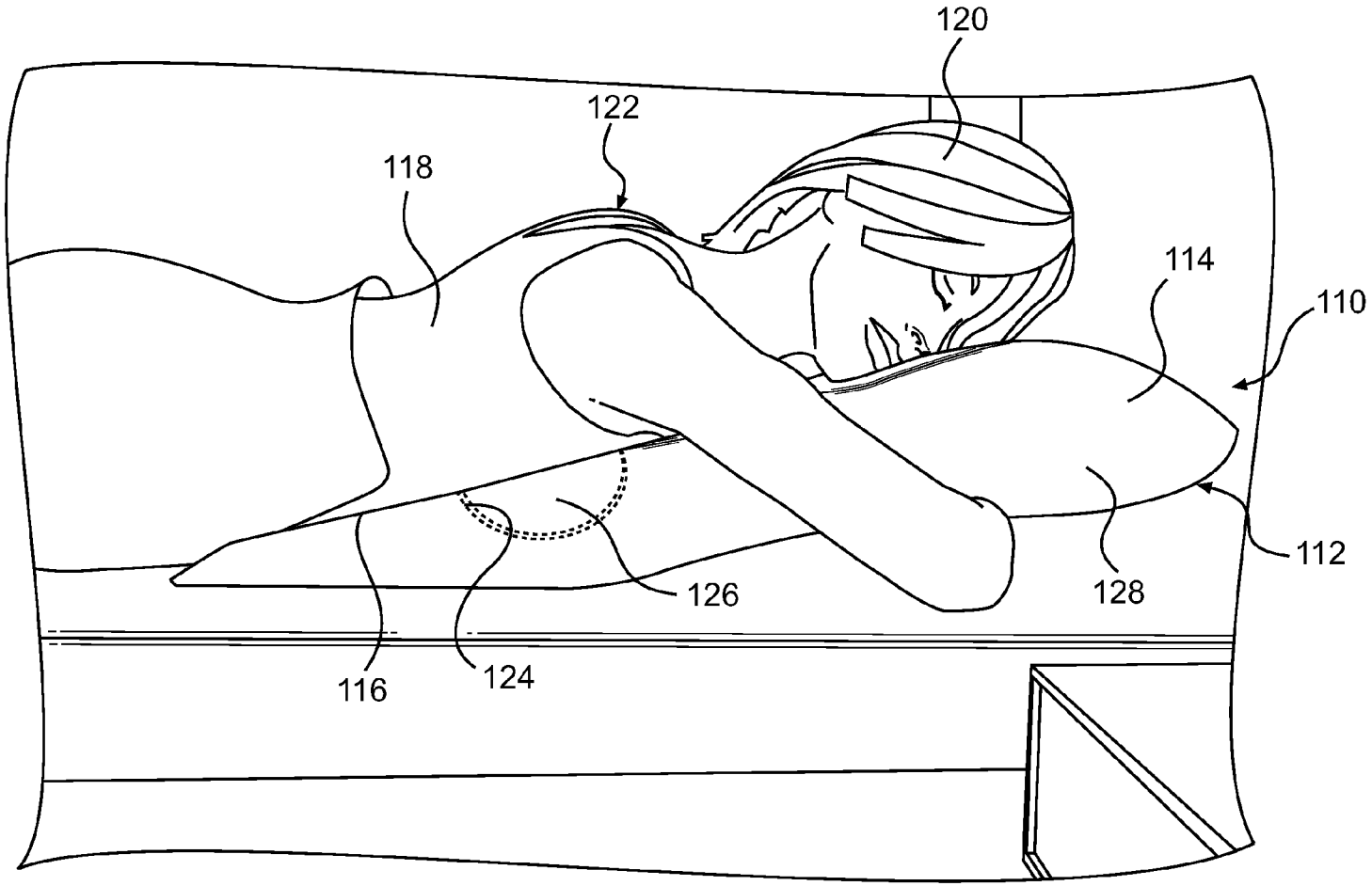
FIG. 1 is a side view of an individual/woman face down using the present invention.

110 breast support pillow
112 wedge-shaped rectangular pad of pillow 110
114 thicker top end of pad 112
116 inclined upper surface of pad 112
118 torso of woman 122
120 head of woman 122
122 woman
124 double cup recess in upper surface 116
126 breasts of woman 122
128 memory foam material for pad 112 and double cup insert 130
130 double cup insert of pillow 110
132 indentation in double cup insert 130
134 pillowcase of pillow 110
136 double cup opening in pillowcase 134

DETAILED DESCRIPTION OF THE PREFERRED EMBODIMENT

Referring now to the figures, in which like numerals indicate like parts, and particularly to FIGS. 1 through 5, and as such, will be discussed with reference thereto.

The present invention is a breast support pillow 110 that comprises a wedge-shaped rectangular pad 112 thicker at a top end 114 with an inclined upper surface 116 and being of sufficient length to support a torso 118 and a head 120 of an individual/woman 122. The pad 112 has a double cup recess 124 within the upper surface 116 at about mid-point of the length of the pad 112 to receive the breasts 126 of the individual/woman 122 in a comfortable manner therein.

Figure 5:
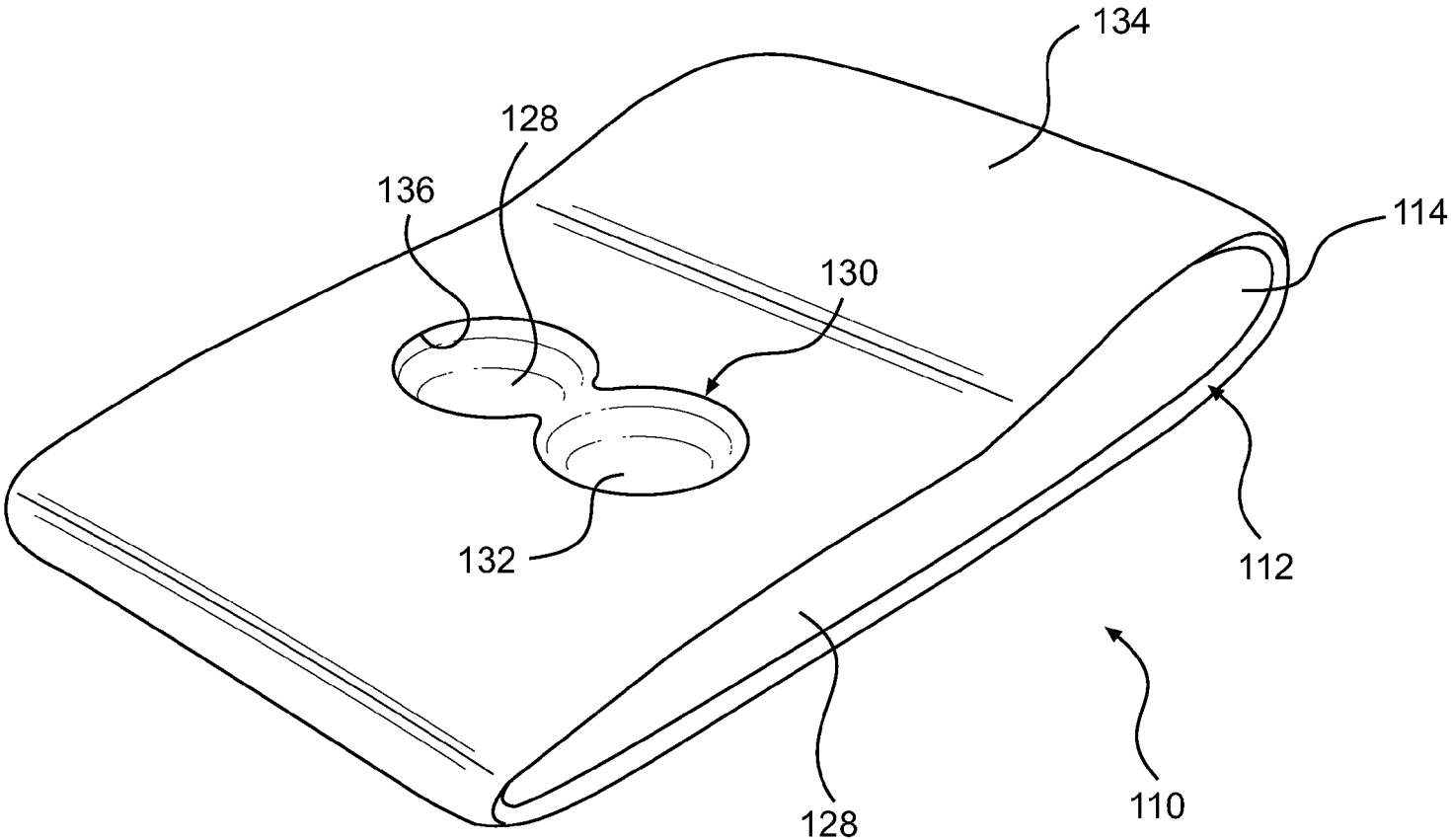
FIG. 5 is a side perspective view of the present invention placed within a special configured pillowcase.

The pad 112 is comprised out of a memory foam material 128 (or polyurethane, polyethylene and generic cushion materials). The pillow 110 further comprises a double cup insert 130 that can be removably placed within the double cup recess 124 of the pad 112 to help support the breasts 126 of the individual/woman 122. The double cup insert 130 is comprised out of the memory foam material 128 (or polyurethane, polyethylene and generic cushion materials). The double cup insert 130 can be comprised with different indentations 132 to accommodate differed sized breasts 126. The double cup insert 130 is formed in stack. One insert is on the top of the other insert 130. The smallest size of insert 130 is on the top of the stack. The pillow as shown in FIG. 5 can further comprise a pillowcase 134 having a double cup opening 136 therein. When the pillowcase 134 is placed over the pad 112, the double cup opening 136 will be positioned over the double cup recess 134 to hold the double cup insert 130 in place.

Figure 2:
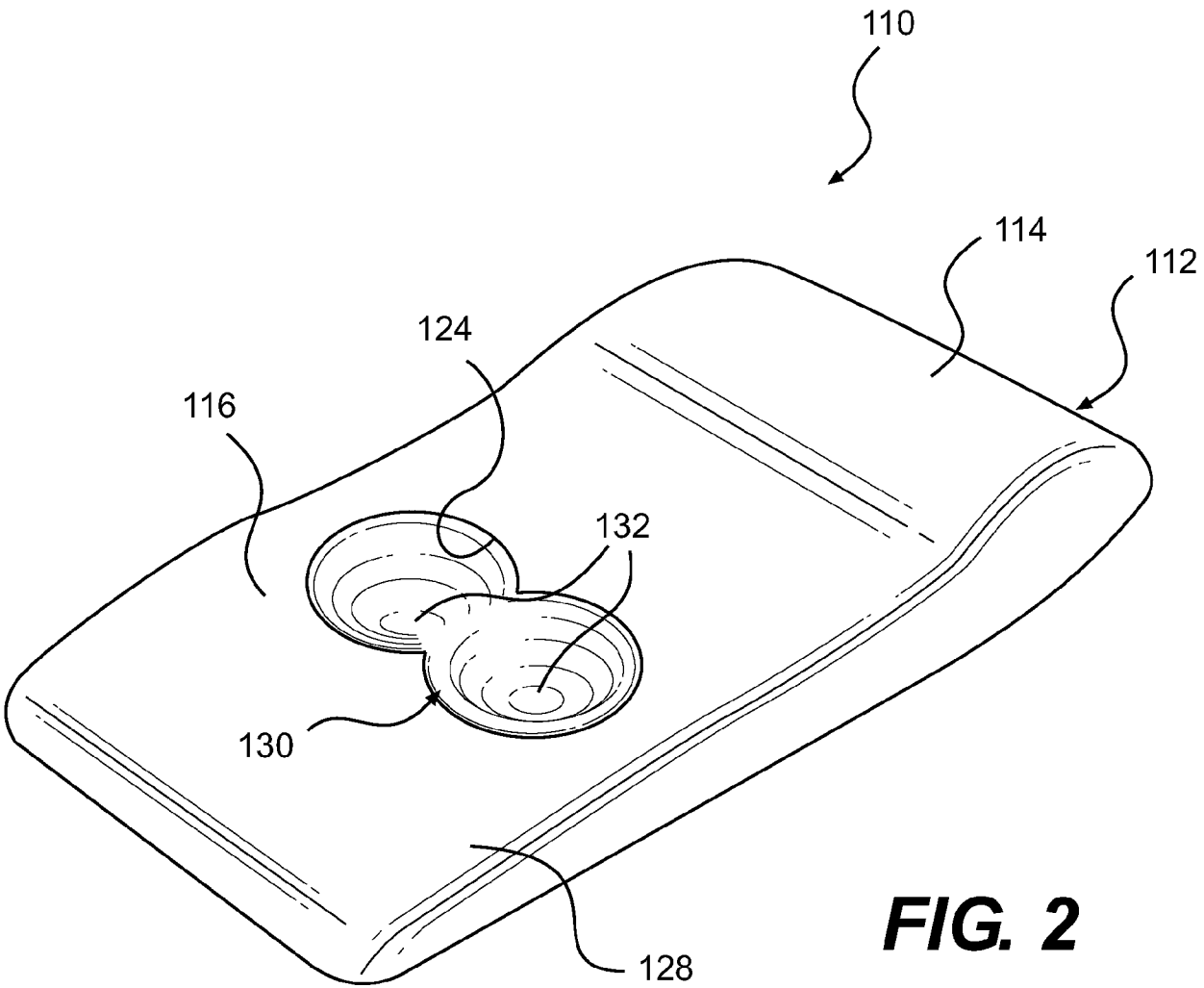
FIG. 2 is a side perspective view of the present invention.
Figure 3:
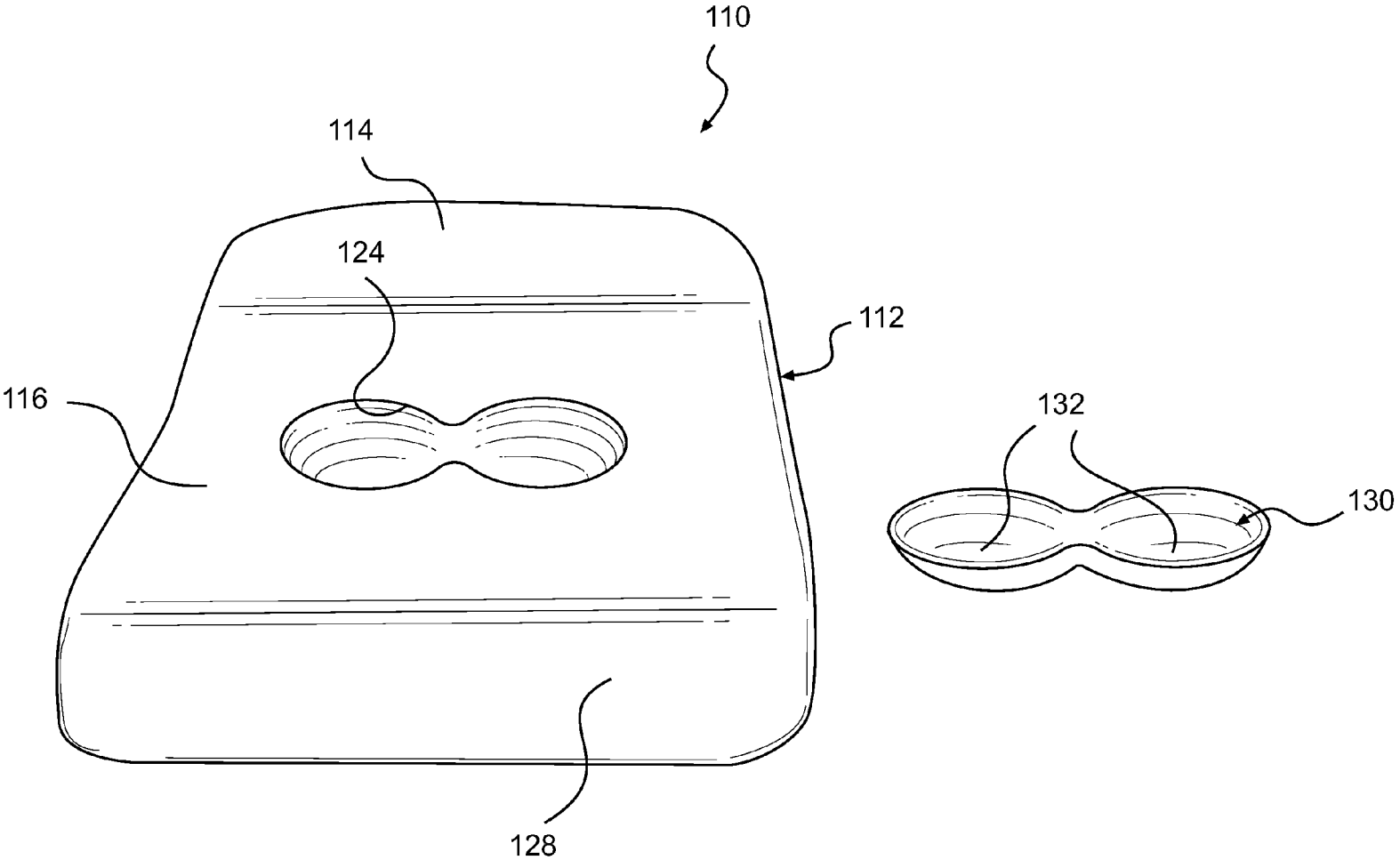
FIG. 3 is a front perspective view of the present invention with the double cup insert removed therefrom.
Figure 4:
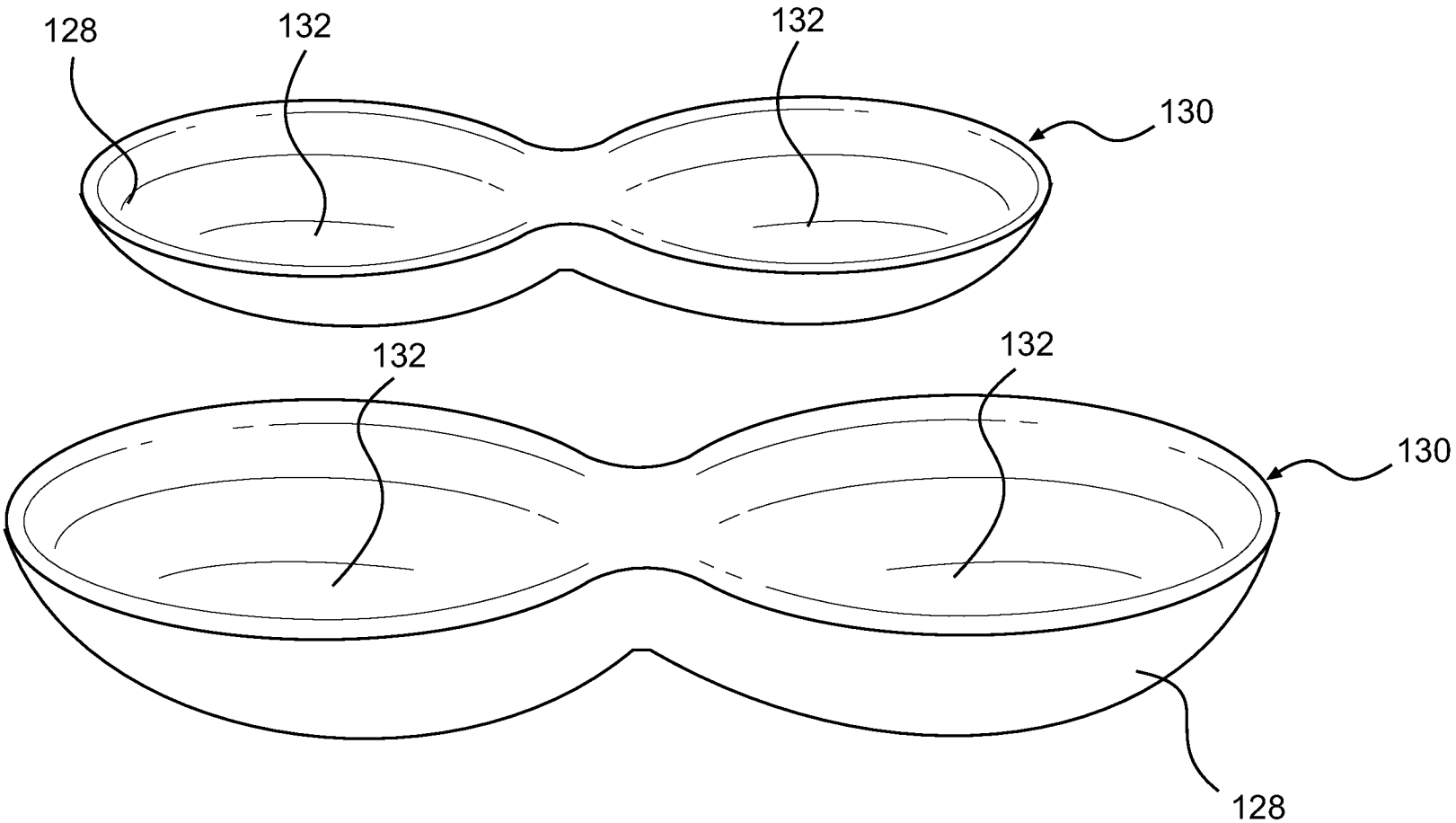
FIG. 4 is a front perspective view showing two different sized double cup insert.

In summary, the breast support pillow 110 assists the individual/woman 112 with large breasts 126 or sensitive breasts 126 in getting a proper night's sleep. The pillow 110 is made from the memory foam material 128 (or polyurethane, polyethylene and generic cushion materials). The pad 112 of the pillow 110 is thicker at the top end 114 to accommodate the head 120 of the individual/woman 122 and has the inclined upper surface 116. Approximately twelve inches down from the top end 114 is the double cup recess 124 for the breasts 126. Each opening in the double cup recess 124 is approximately seven (7) inches in diameter. The removable pillow insert 130 can be placed into the double cup recess 124 to tailor the pillow 110 to various breast sizes. The indentations 132 in the double cup insert 130 will come in various sizes, such as three inches, four inches, five inches and six inches (as shown in FIGS. 2-4). The double cup insert 130 is formed in stack (as shown in FIG. 4). One insert is on the top of the other insert 130. The smallest size of insert 130 is on the top of the stack. The pillowcase 134 has the double cup opening 136 to hold a stack of the double cup insert 130 in place. The individual/woman 122 can lie face down on the pillow 110 and place her breasts 126 into the double cup recess 124. For a small-breasted woman 122, a stack of the double cup insert 130 is used. For a large breasted individual/woman 122, the user can remove some or all of the double cup insert 130 in the stack (as shown in FIG. 4). The insert 130 can be single cup insert. The individual/woman can use a double cup insert 130 or two single cup insert (not shown). The pillow 110 can be customized for different individual use. The pillow 110 may be white or can come in other colors or printed with decoration. The exact specifications may vary.

It will be understood that each of the elements described above, or two or more together, may also find a useful application in other types of constructions differing from the types described above.

While the invention has been illustrated and described as embodiments of a breast support pillow, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A breast support pillow which comprises:

a wedge-shaped rectangular flat even surface pad thicker at a top end with an inclined upper surface and being of sufficient length to support a torso and a head of a woman;

a double cup recess within the upper surface of the pad at about mid-point of the length of the pad to receive the breasts of the woman in a comfortable manner therein;

wherein the cup recess has a diameter about seven inches;

different indentations were formed inside of the double cup recess; and a double cup insert that can be removably placed within the double cup recess of the pad to help support the breasts of the woman.

2. The pillow as recited in claim 1, wherein the pad is comprised out of a memory foam material.

3. The pillow as recited in claim 1, wherein the pad is select from a group consisting of polyurethane, polyethylene and generic cushion material.

4. The pillow as recited in claim 1, wherein the double cup insert is comprised out of a memory foam material.

5. The pillow as recited in claim 1, wherein the double cup insert is select from a group consisting of polyurethane, polyethylene and generic cushion material.

6. The pillow as recited in claim 1, wherein the double cup insert can be formed in stack with three inches, four inches, five inches, and six inches in diameter sizes in order to accommodate different indentations in the recess for different sized breasts.

7. The pillow as recited in claim 1, further comprising a pillowcase having a double cup opening therein, whereby when the pillowcase is placed over the pad, the double cup opening will be positioned over the double cup recess to hold a stack of double cup inserts in place.

8. The pillow as recited in claim 1, wherein single cup insert can be used to fill the recess.

* * * * *